US006991312B2

(12) United States Patent
Uwagaki et al.

(10) Patent No.: US 6,991,312 B2
(45) Date of Patent: Jan. 31, 2006

(54) PRINT HEAD MAINTENANCE MECHANISM

(75) Inventors: Hideo Uwagaki, Kyoto (JP); Ryoichi Kawai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 61 days.

(21) Appl. No.: 10/393,007

(22) Filed: Mar. 21, 2003

(65) Prior Publication Data

US 2003/0179261 A1 Sep. 25, 2003

(30) Foreign Application Priority Data

Mar. 22, 2002 (JP) ..... P2002-080961

(51) Int. Cl.
*B41J 2/165* (2006.01)

(52) U.S. Cl. ..... 347/29; 347/32; 347/33; 347/30

(58) Field of Classification Search ..... 347/29–33, 347/23, 35

See application file for complete search history.

(56) References Cited

U.S. PATENT DOCUMENTS 5,138,343 A * 8/1992 Aichi et al. ..... 347/30
5,406,317 A 4/1995 Shimamura et al. ..... 347/23
5,455,609 A 10/1995 Gast et al. ..... 347/32
6,132,027 A * 10/2000 Suzuki et al. ..... 347/33
6,398,338 B1 * 6/2002 Berg et al. ..... 347/32
2002/0003553 A1 1/2002 Ng ..... 347/22

FOREIGN PATENT DOCUMENTS

EP 0 913 264 A2 5/1999
JP 11192716 A * 7/1999
JP 2000-203042 7/2000
JP 2000-233517 8/2000
JP 2002-036578 A 2/2002

OTHER PUBLICATIONS

European Search Report, Dec. 11, 2003, Kulnanck, P, EP 03006492.

* cited by examiner

*Primary Examiner*—Shih-Wen Hsieh
(74) *Attorney, Agent, or Firm*—Birch, Stewart, Kolasch & Birch, LLP.

(57) ABSTRACT

An object of the invention is to provide a less costly print head maintenance mechanism featuring a compact, simple construction and negating the need for a widthwise increase of space for permitting vertical movement of the print head maintenance mechanism. The mechanism is designed to utilize the rotation of first cams and second cams for switching cap holders and wiper holders to a printing mode position for permitting a normal printing operation, a capping mode position for sealing a nozzle surface at a print head with the cap, and a wiping mode position for cleaning by wiping the nozzle surface with the wiper.

4 Claims, 10 Drawing Sheets

PRINT HEAD MAINTENANCE MECHANISM

This nonprovisional application claims priority under 35 U.S.C. § 119(a) on Patent Application No(s). 2002-80961 filed in JAPAN on Mar. 22, 2002, which is (are) herein incorporated by reference.

BACKGROUND OF THE INVENTION

1. Field of the Invention

The present invention relates to a maintenance mechanism for cleaning and protecting a print head of a printing machine of the ink jet printing system wherein printing is performed by jetting ink droplets onto a receiving medium.

2. Description of the Related Art

Ink-jet printing machines generally have three modes of operations which include a printing operation for printing on a receiving medium, a capping operation for protecting a print head and preventing nozzles from drying, and a wiping operation for cleaning by wiping surfaces of the nozzles of the print head. FIGS. 11A to 11C illustrate an example of the conventional print head maintenance mechanism, while an example of such an arrangement of the maintenance mechanism is disclosed in Japanese Unexamined Patent Publication JP-A 2000-233517 (2000).

FIG. 11A shows a state where a nozzle portion disposed at a respective bottom of a first and a second print head 3, 4 (lower portions as seen in the figure) is sealed by a respective cap 7*a*, 7*b*. The first and second print heads 3, 4 are mounted to a carriage 2 adapted to reciprocate along a primary scanning direction as carried on a carriage shaft 5 extended transversely of a main frame 1. At this time, a slide case 6 provided with the caps 7*a*, 7*b* is positioned at a left end of the main frame 1 as operatively connected with the carriage 2 as shown in FIG. 11A, the left end of the main frame 1 defining one end of a primary scanning movement. That is, the slide case 6 is placed at an uppermost position (a top dead center) by means of a function of sliding projections C slidably engaged with slanted cam grooves B formed in a base portion 9 of the printing machine, so that the print heads 3, 4 are sealed by the caps 7*a*, 7*b*.

FIG. 11B shows a state where the wiping operation is being carried out for cleaning by wiping the nozzle surfaces at the print heads 3, 4. At this time, the slide case 6 has the sliding projections C thereof fixed to a respective intermediate position of the cam grooves B by means of a lock mechanism (not shown), so that the caps 7*a*, 7*b* are spaced away from the nozzle surfaces at the print heads 3, 4. The carriage 2 passing over wipers 8 permits the wipers 8 to wipe and clean the nozzle surfaces at the print heads 3, 4.

FIG. 11C shows a state where the printing operation is being carried out. At this time, the carriage 2 is further moved rightward from the position shown in FIG. 11B or moved toward the other end of the primary scanning movement relative to the main frame 1 by a distance L1 from the one end of the primary scanning movement, thus entering a printing region for performing the printing operation. In this state, the slide case 6 is released from the locked state while the sliding projections C rest at a respective right end of the cam grooves B in conjunction with the movement to the other end of the primary scanning movement relative to the main frame 1. The slide case 6 is at a lowermost position (a bottom dead center) or at such a height as to bring the wipers 8 and caps 7*a*, 7*b* out of interference with the operating print heads 3, 4, so that a normal printing operation is allowed.

According to the conventional example mentioned above, a main body of the printing machine requires a further widthwise (the primary scanning direction) increase of space, such that the slide case 6 may be allowed to move a distance L2 from the one end of the primary scanning movement relative to the main frame 1 thereby permitting a sequence of oblique sliding movements of the maintenance mechanism. Specifically, the space represented by L2 in the figure is required to permit the slide case 6 to move up and down or to permit the sliding projections C in loose fit with the cam grooves B to slidably move in conjunction with the movement of the carriage 2. This requires the further widthwise increase of space of the printing machine, which results in an increased widthwise dimension of the machine.

As a solution to this problem, for example, Japanese Unexamined Patent Publication JP-A 2000-203042 (2000) discloses an arrangement wherein a maintenance station is disposed within the printing region. In this case, a motor conventionally provided for driving a sheet feed roller or feed roller is utilized for driving the maintenance station. However, such an arrangement encounters a complicated structure of a drive force transmission mechanism and an increased number of components thereof. Consequently, a driving system has a complicated structure of a complicated control, which results in increased costs.

On the other hand, U.S. Pat. No. 5,455,609 discloses an arrangement employing the following drive force transmission mechanism for vertically moving the maintenance station. The transmission mechanism is arranged such that a worm gear mounted to an output shaft of a motor is meshed with a wheel gear, which is meshed with a rack. Unfortunately, this arrangement also suffers the complicated structure of the driving system.

SUMMARY OF THE INVENTION

In view of the foregoing, an object of the invention is to provide a less costly print head maintenance mechanism accomplishing a compact and simple construction by negating the need for the further widthwise increase of space for permitting the print head maintenance mechanism to move up and down.

The invention provides a print head maintenance mechanism for use in an ink jet printing machine in which printing is carried out by driving a carriage carrying a print head, the maintenance mechanism comprising:

a cap for preventing a nozzle provided at the print head from drying;

a cap holder retaining the cap and allowed to move along directions orthogonal to a primary scanning direction and a secondary scanning direction of the print head;

a first cam which is rotated at a predetermined position;

first biasing means for biasing the cap holder against the first cam;

a wiper for cleaning by wiping a surface of the nozzle provided at the print head;

a second cam which is rotated at a predetermined position;

a wiper holder retaining the wiper and allowed to move along directions orthogonal to the primary scanning direction and the secondary scanning direction of the print head; and second biasing means for biasing the wiper holder against the second cam, wherein the first and second cams are mounted to a single cam shaft, and wherein the cam shaft is rotated through one revolution for switching the cap holder and wiper holder between a printing mode position for permitting a normal printing operation, a capping mode position for sealing the surface of the nozzle at the print head with the cap, and a wiping mode position for cleaning by wiping the nozzle surface with the wiper.

According to the invention, the cam shaft assembled with the two cams is rotated through one revolution thereby permitting the maintenance mechanism to be switched to the three mode positions. Therefore, the maintenance mechanism may be constructed in a simple structure of an easy control, which results in a low cost fabrication of the maintenance mechanism.

Thus, the invention is adapted to shift the cap holder and the wiper holder along the directions orthogonal to the primary scanning direction and the secondary scanning direction by way of rotation of the first and second cams. Specifically, in a case where the ink jet printing machine is disposed in a horizontal position, the cap holder and the wiper holder are shifted vertically so as to be switched to the printing mode position for permitting the normal printing operation, the capping mode position for sealing the surface of the nozzle at the print head, and the wiping mode position for cleaning by wiping the nozzle surface. Hence, the invention only needs to provide a space allowing for the vertical movements of the cap holder and the wiper holder, negating the need for the further widthwise increase of space. The provision of the print head maintenance mechanism does not require the ink jet printing machine to be further increased in the widthwise dimension so that the printing machine can accomplish a compact design. In addition, the rotation of a single cam shaft brings the two cams into rotation to switch the maintenance mechanism to the three mode positions. This ensures positive maintenance operations. Furthermore, the invention implements the switching function in a simple construction of an easy control, contributing to the low cost fabrication of the maintenance mechanism.

In addition, the invention accomplishes the switching to the three mode positions by rotating the cam shaft assembled with the two cams through one revolution and hence, the maintenance mechanism may be constructed in a simple construction of an easy control, which results in the low cost fabrication of the maintenance mechanism.

In the invention, it is preferable that the first biasing means for biasing the cap holder against the first cam comprises a pair of tension springs disposed at places on one of the diagonal lines of the cap holder as equi-spaced from the cam shaft.

According to the invention, the pair of tension springs as the first biasing means are disposed at places on one of the diagonal lines of the cap holder as equi-spaced from the cam shaft so that the cap holder may be biased against the cam in a well-balanced fashion. In addition, the first biasing means has a simple construction, contributing to the low cost fabrication of the maintenance mechanism.

In the invention, it is preferable that the second biasing means for biasing the wiper holder against the second cam comprises a pair of tension springs disposed at places on opposite sides of the cam shaft as equi-spaced from an axis of the wiper holder orthogonal to the cam shaft.

According to the invention, the pair of tension springs as the second biasing means are disposed at places on the opposite sides of the cam shaft as equi-spaced from the axis of the wiper holder orthogonal to the cam shaft so that the wiper holder may be biased against the cam in a well-balanced fashion. In addition, the second biasing means has a simple construction, contributing to the low cost fabrication of the maintenance mechanism.

Thus, the invention permits the wiper holder to be biased against the cam in a well-balanced fashion because the pair or tension springs as the second biasing means are disposed at places on the opposite sides of the cam shaft as equi-spaced from the axis of the wiper holder. Furthermore, the invention implements the second biasing means in a simple construction, thus offering the less costly maintenance mechanism.

In the invention, it is preferable that the first biasing means for biasing the cap holder against the first cam comprises a pair of tension springs disposed at places on one of the diagonal lines of the cap holder as equi-spaced from the cam shaft, and that the second biasing means for biasing the wiper holder against the second cam comprises a pair of tension springs disposed at places on opposite sides of the cam shaft as equi-spaced from an axis of the wiper holder orthogonal to the cam shaft.

According to the invention, the pair of tension springs as the first biasing means for the cap holder are disposed at places on one of the diagonal lines of the cap holder as equi-spaced from the cam shaft while the pair of tension springs as the second biasing means for the wiper holder are disposed at places on the opposite sides of the cam shaft as equi-spaced from the axis of the wiper holder. Hence, the first and second biasing means are capable of biasing the cap holder and the wiper holder against the first cam and the second cam in a well-balanced fashion, respectively. Furthermore, the first and second biasing means have simple constructions, thus contributing to the low cost fabrication of the maintenance mechanism.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
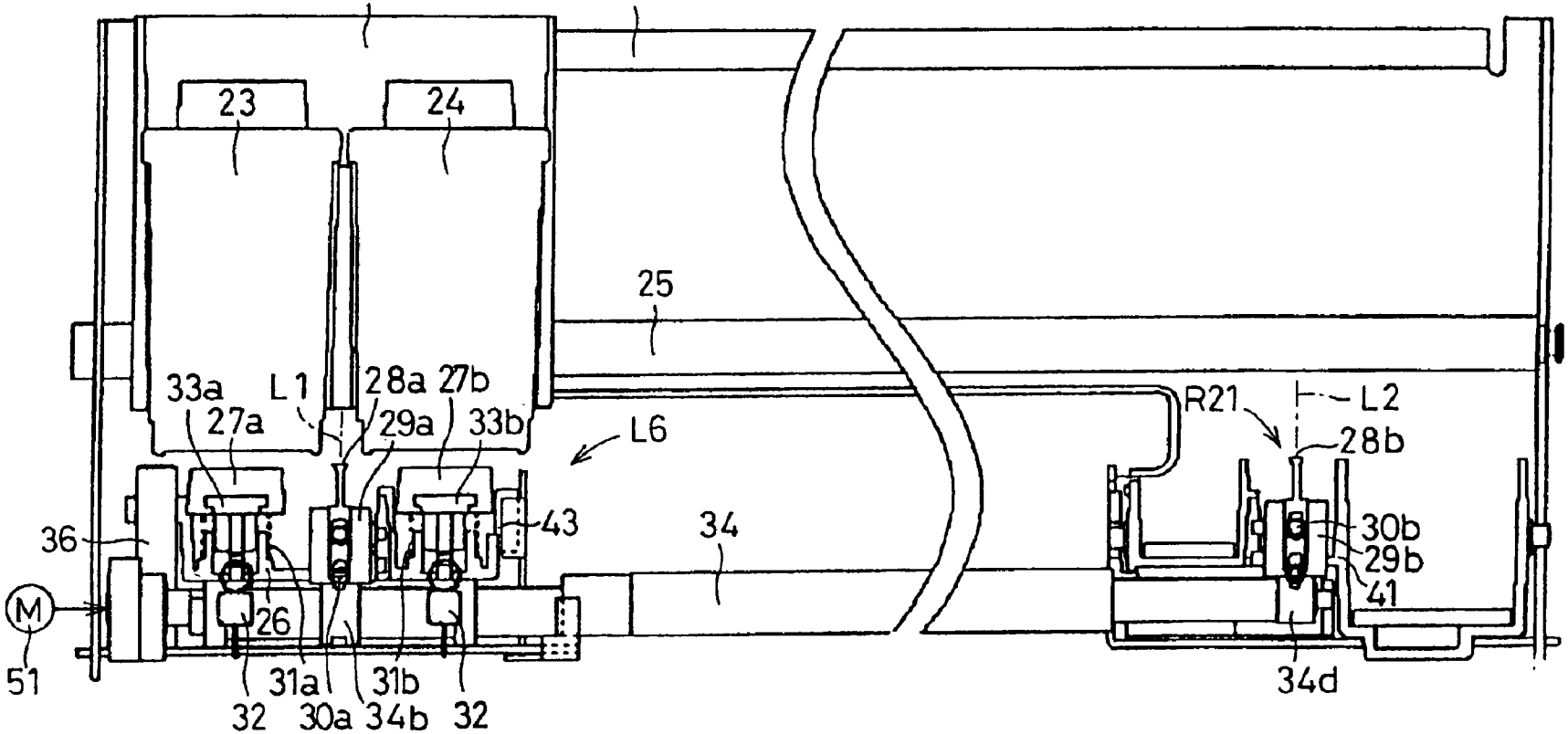
FIG. 1 is a front view showing a normal mode (during a printing operation) of a print head maintenance mechanism according to one embodiment of the invention.

Now referring to the drawings, preferred embodiments of the invention are described below.

A print head maintenance mechanism according to one embodiment of the invention will hereinbelow be described with reference to the accompanying drawings.

FIGS. 1 to 6 each shows a respective operation mode of the print head maintenance mechanism. As shown in these figures, a pair of print heads 23, 24 are mounted to a carriage 22 adapted to reciprocate on a carriage shaft 25 along a primary scanning direction, the carriage shaft 25 extended transversely of a main frame 21. The print head 23 on one side is loaded with a color ink cartridge, whereas the other print head 24 is loaded with a monochromatic ink cartridge.

Caps 27*a*, 27*b* for preventing nozzles (not shown) provided at the print heads 23, 24 from drying are mounted to cap holders 33*a*, 33*b* as constantly biased upward by helical compression springs 31*a*, 31*b*. The cap holders 33*a*, 33*b* are vertically movably mounted to one L6 of maintenance stations which is disposed on one side of the main frame 21 with respect to a primary scanning direction, or on the left side as seen in the FIG. 1.

The maintenance station L6 is allowed to move up and down as guided by a guide boss 36 standing upright from the main frame 21 and a guide rail 43 formed by bending a part of the main frame 21. The maintenance station L6 is biased toward a bottom of the main frame 21, or downwardly as seen in FIG. 1, by means of a pair of tension springs 32 as first biasing means stretched between the maintenance station L6 and the main frame 21, so that the cap holders 33*a*, 33*b* are constantly biased against first cams 34*a*, 34*c* at their bottoms.

One 28*a* of wipers for cleaning by wiping surfaces of the nozzles is fixed to a wiper holder 29*a*. The wiper holder 29*a* is vertically movably retained and guided by a guide member standing upright from the maintenance station L6 on one side. The wiper holder 29*a* is also biased toward the bottom of the main frame 21 or downwardly as seen in FIG. 1 by a pair of tension springs 30*a* as second biasing means stretched between the wiper holder 29*a* and the maintenance station L6, so that the wiper holder 29*a* is constantly biased against a second cam 34*b* at its bottom.

The other wiper 28*b* is fixed to a wiper holder 29*b*. The wiper holder 29*b* is vertically movably retained and guided by a guide member standing upright from the other maintenance station R21 fixed to place on the other side of the main frame 21 with respect to the primary scanning direction, or on the right side as seen in the FIG. 1. The wiper holder 29*b* is constantly biased against a second cam 34*d* at its bottom by means of a pair of tension springs 30*b* as second biasing means stretched between the wiper holder 29*b* and the maintenance station R21.

The first cams 34*a*, 34*c* and the second cams 34*b*, 34*d* are fixedly mounted to a single cam shaft 34. A motor 51 (dedicated to the maintenance mechanism) operatively connected with the cam shaft 34 is rotated thereby shifting the cap holders 33*a*, 33*b* and the wiper holders 29*a*, 29*b* in a direction orthogonal to the primary scanning direction or to a secondary scanning direction of the carriage 22. Specifically, in a case where the main frame 21 is mounted in a horizontal position, the cap holders and wiper holders are shifted vertically, so as to be switched to three mode positions which include a printing mode position for permitting a normal printing operation (see FIGS. 1 and 2), a wiping mode position for cleaning by wiping the nozzle surfaces (see FIGS. 3 and 4), and a capping mode position for sealing the nozzle surfaces (see FIGS. 5 and 6).

The cap holders 33*a*, 33*b* are formed, for example, in a square shape in section taken at right angles to its axis. The pair of tension springs as the pair of the first biasing means 32 are disposed at places on one of the diagonal lines of each cap holder 33*a*, 33*b* in section taken at right angles to its axis as equi-spaced from the cam shaft 34. The pair of tension springs 32 have the same spring constant.

The pair of tension springs as the pair of the second biasing means 30*a* are disposed at places on opposite sides of an axis L1 of the wiper holder 29*a* orthogonal to the cam shaft 34 as equi-spaced from the cam shaft 34. The pair of tension springs 30*a* have the same spring constant.

The pair of tension springs as the pair of the second biasing means 30*b* are disposed at places on opposite sides of an axis L2 of the wiper holder 29*b* orthogonal to the cam shaft 34 as equi-spaced from the cam shaft 34. The pair of tension springs 30*b* have the same spring constant.

The pair of the first biasing means 32 for biasing the maintenance station L6 downwardly are disposed at symmetrical places with respect to an axis of the cam shaft 34 or equi-spaced from abutment places between the cap holders 33*a*, 33*b* and the cams. Hence, the cap holders 33*a*, 33*b* are biased against the first cams 34*a*, 34*c* in a well-balanced fashion. Likewise, the wiper holder 29*a* on one side is also biased against the second cam 34*b* by means of the pair of the second biasing means 30*a* disposed at symmetrical places with respect to the axis of the cam shaft 34 or equi-spaced from an abutment place between the wiper holder 29*a* and the second cam 34*b*. Therefore, the wiper holder 29*a* is biased in a stable manner. Similarly, the other wiper holder 29*b* is also biased against the second cam 34*d* by means of the pair of the second biasing means 30*b*, 30*b* disposed at symmetrical places with respect to the axis of the cam shaft 34 or equi-spaced from an abutment place between the wiper holder 29*b* and the second cam 34*d*. Therefore, the wiper holder 29*b* is biased in a stable manner. Such a simple construction ensures that the cap holders 33*a*, 33*b* and the wiper holders 29*a*, 29*b* are positively moved up and down, thus contributing to the low cost fabrication of the maintenance mechanism.

On the other hand, the cam shaft 34 is disposed directly under the maintenance station L6 and the maintenance station R21 and is rotated by the motor 51 via a cam gear 35 and a gear not shown. An initial position of the cam shaft 34 is detected by means of a position detection switch 42 disposed at a place corresponding to the cam gear 35. The motor 51 is controlled based on a counted number of feed steps, so as to permit the mechanism to be switched to the three mode positions including the printing mode position, capping mode position and wiping mode position.

Figure 7:
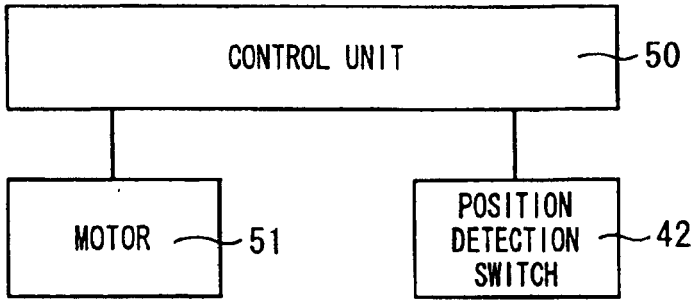
FIG. 7 is a block diagram schematically showing an electrical configuration of the print head maintenance mechanism.

FIG. 7 is a block diagram schematically showing an electrical configuration of the print head maintenance mechanism. The operations of the print head maintenance mechanism are controlled by a control unit 50 so implemented as to include a central processing unit (CPU) and the like. The control unit 50 is electrically connected with the motor 51 for rotating the cam shaft 34 and is also electrically connected with the position detection switch 42.

For a mere reference purpose, preferred rotational angles for the cam shaft 34 to assume the respective mode positions according to the embodiment are listed as below: From normal (printing) mode to wiping mode: 97.1°, From wiping mode to capping mode: 112.2°, and From capping mode to normal (printing) mode: 150.7°.

With such definitions of the rotational angles, rotating the cam shaft 34 through one revolution permits the maintenance mechanism to be switched to the three operation modes. Furthermore, the switching from one operation mode to another may be easily controlled.

The print head maintenance mechanism constructed as described above performs a sequence of operations which are switched from the normal printing mode to the wiping mode including purging of waste ink, and then to the capping mode. The following description explains these operations.

Figure 2:
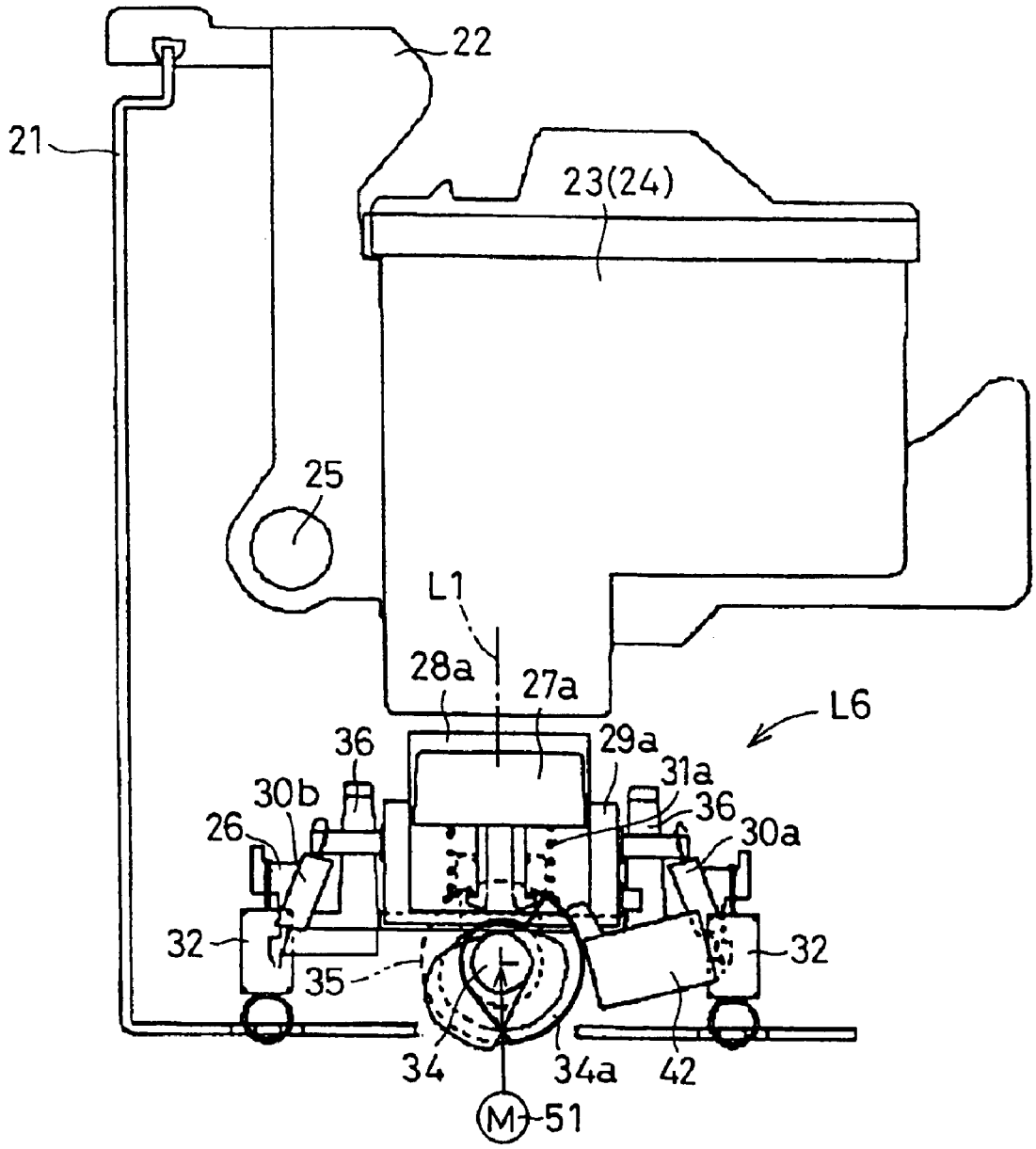
FIG. 2 is a side view showing the mechanism of FIG. 1.

At an input of a print signal from a control system not shown, the control unit 50 firstly rotates the motor 51 to move down the caps 27*a,* 27*b* and the wipers 28*a,* 28*b* to places out of interference with the print heads 23, 24, as shown in FIGS. 1 and 2. Thus, the mechanism takes a position to permit the printing operation (the printing mode position). Subsequently, a sheet fed from a rear side of the main frame 21 is subjected to the printing operation which is performed by ejecting ink based on the print signal while the carriage 22 reciprocates on the carriage shaft 25 along the primary scanning direction. The printing operation is continued with the sheet intermittently advanced precisely along the secondary scanning direction by means of a conveyor roller (not shown).

Figure 3:
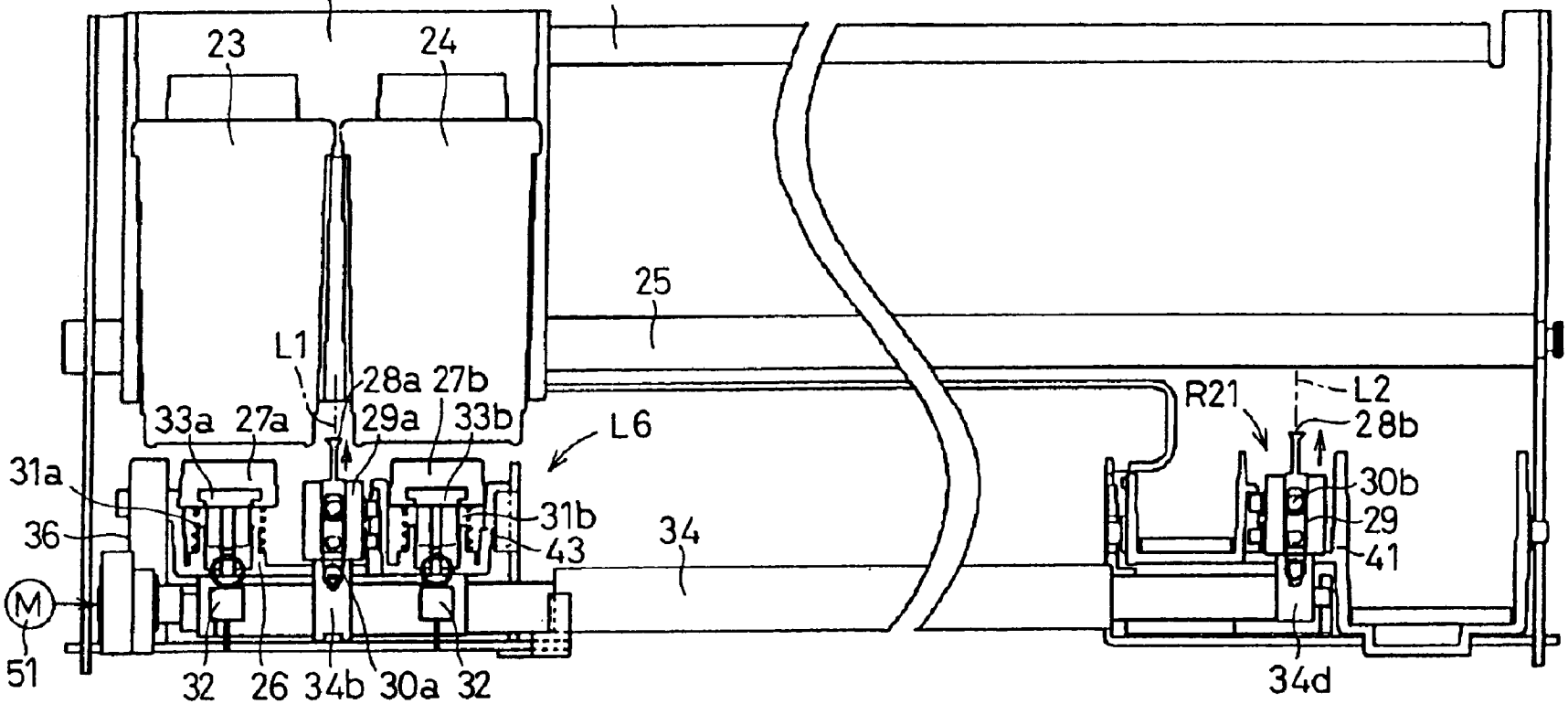
FIG. 3 is a front view showing a wiping mode of the print head maintenance mechanism according the one embodiment of the invention.
Figure 4:
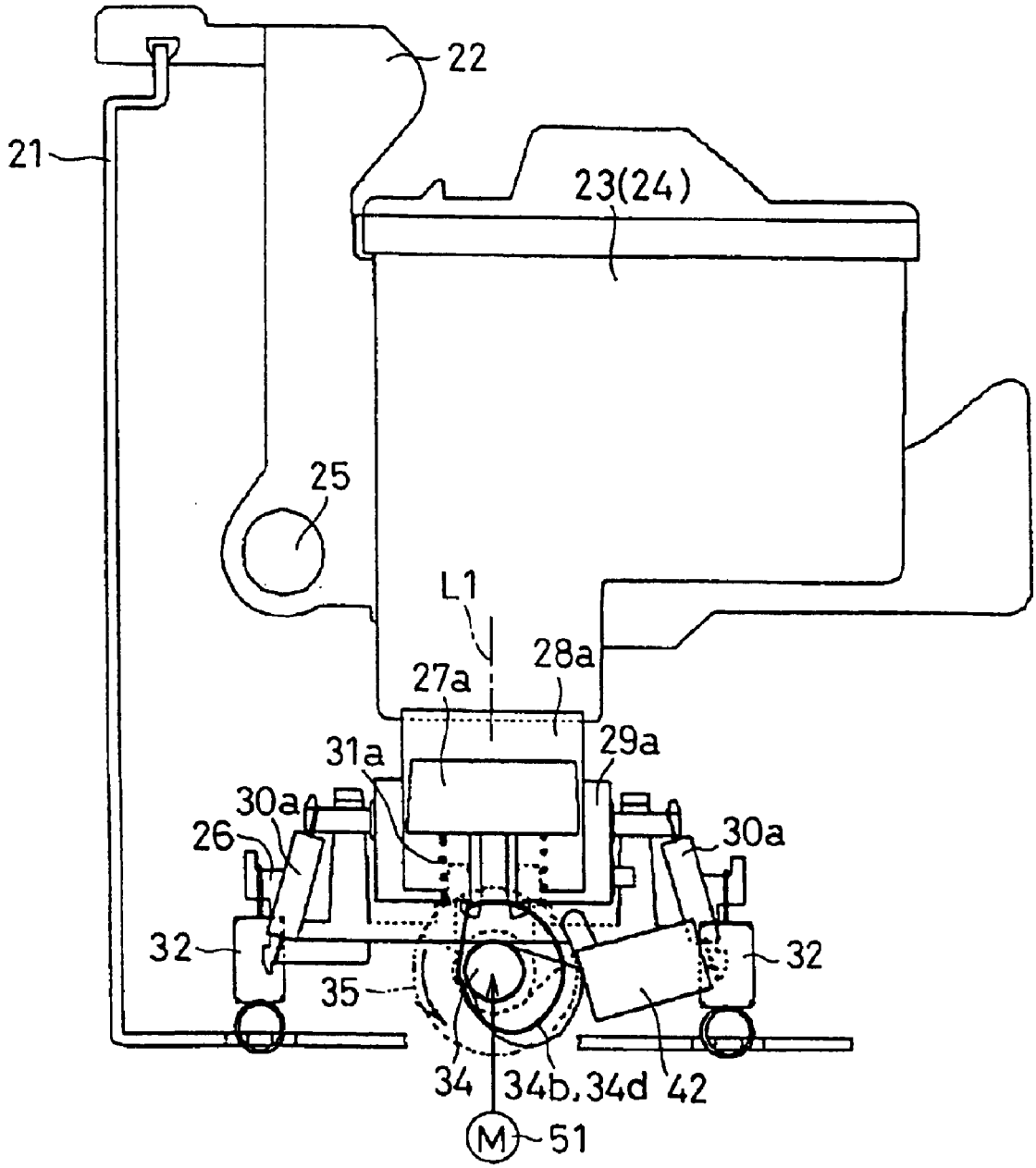
FIG. 4 is a side view showing the mechanism of FIG. 3.

During the printing operation, a cleaning operation is performed at given time intervals for ensuring a print quality, the cleaning operation including the wiping of the nozzle surfaces and purging cleaning for removing waste ink adhered to nozzle apertures by jetting the ink therethrough. As shown in FIGS. 3 and 4, the wiping of the nozzle surfaces is performed by raising the wipers 28*a,* 28*b* of the maintenance stations R21 and L6 to bring the wipers into abutment against the print heads 23, 24 (the wiping mode position). Whenever the wiping operation is finished, the wipers 28*a,* 28*b* are lowered so as to be spaced away from the print heads 23, 24. The purging cleaning is performed by jetting the ink toward a waste ink receiving portion of the maintenance station R21.

Figure 5:
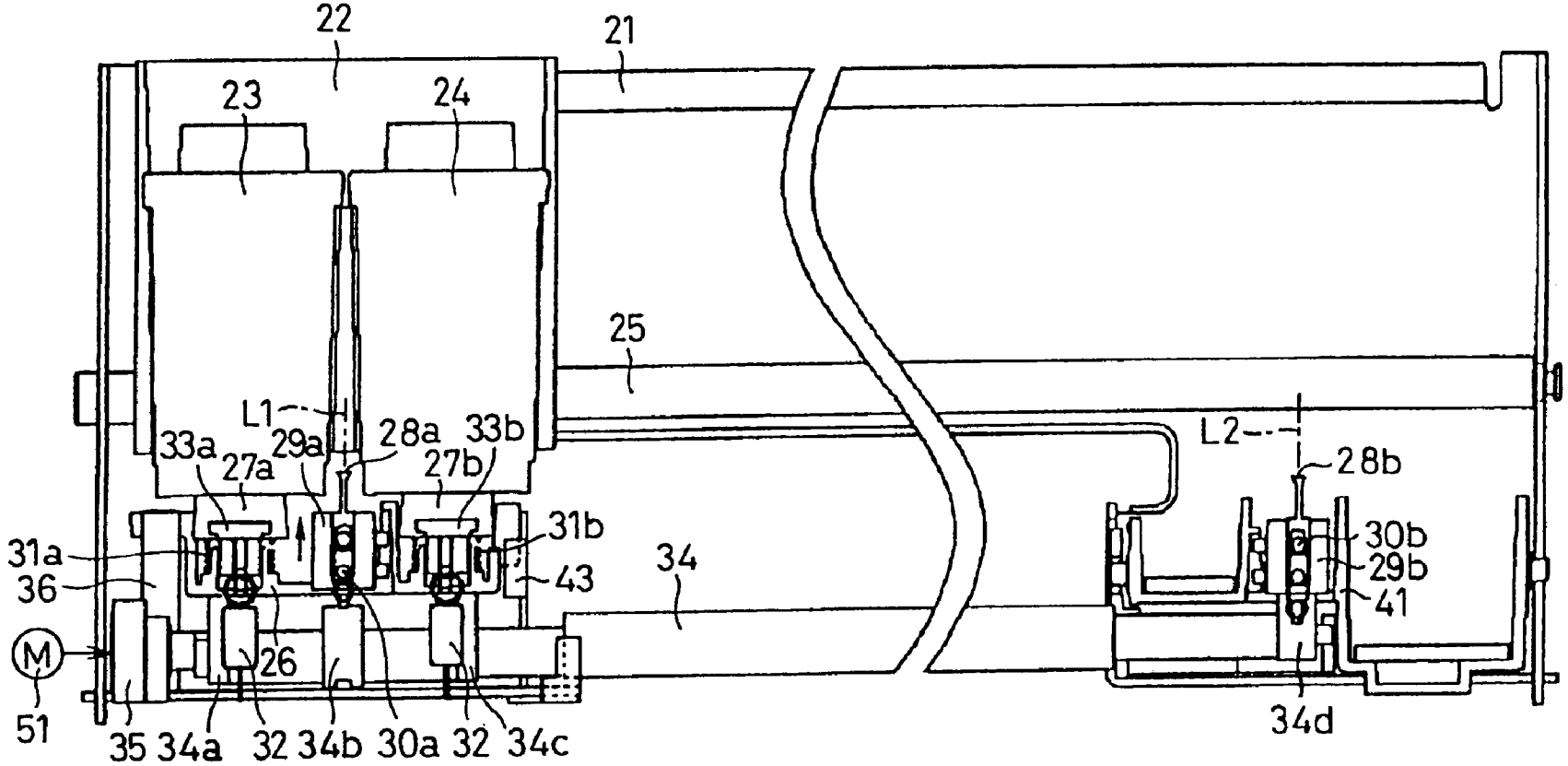
FIG. 5 is a front view showing a capping mode of the print head maintenance mechanism according to the one embodiment of the invention.
Figure 6:
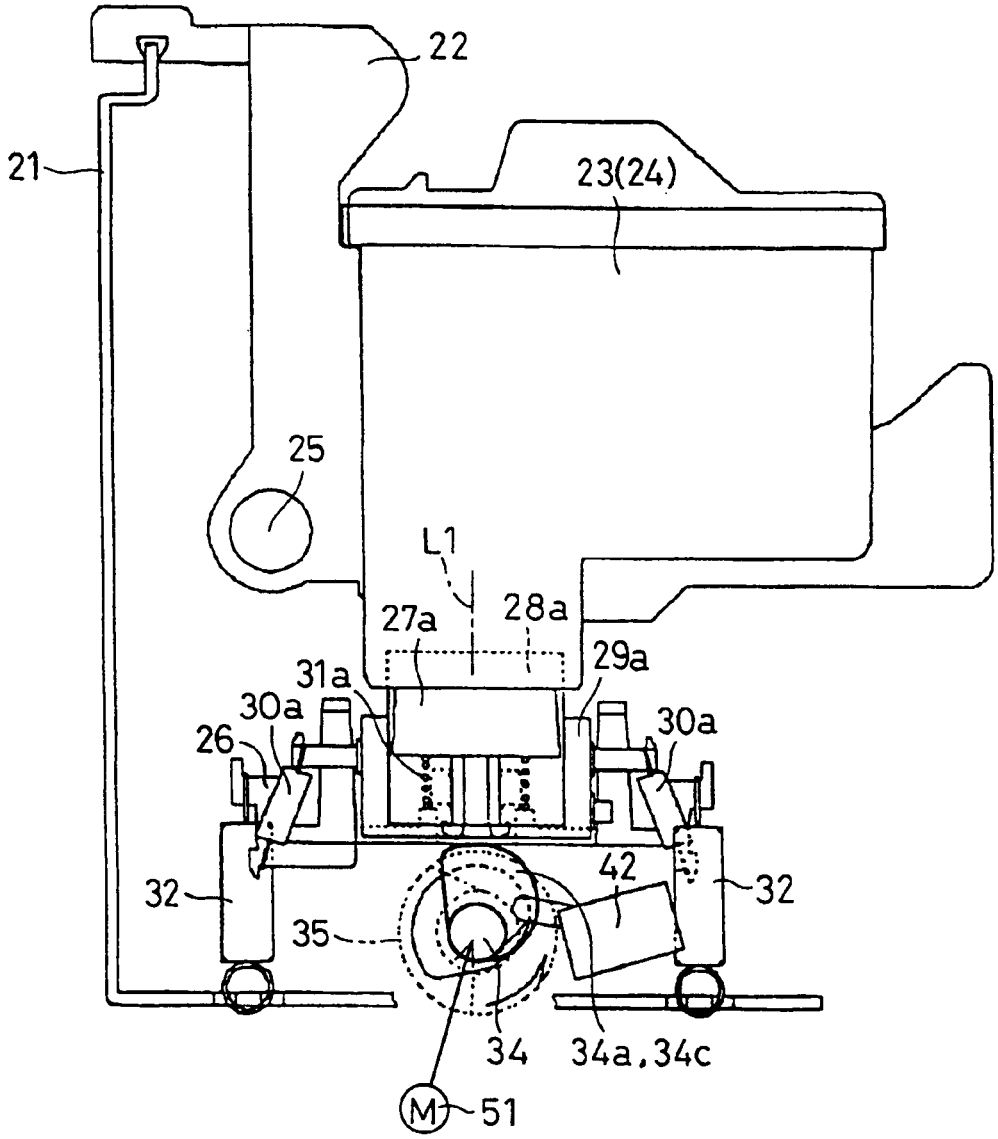
FIG. 6 is a side view showing the mechanism of FIG. 5.

After completion of the printing operation, the sheet is discharged by a discharge roller (not shown) toward the front side with respect to the drawing surface of FIG. 1, for example. Then, the carriage 22 is moved to a standby position on the left side of the figure. On the other hand, the motor is rotated to drive the cam shaft 34 thereby raising the caps 27*a,* 27*b* which, in turn, seal the print heads 23, 24, as shown in FIGS. 5 and 6 (the capping mode position) . Thus is accomplished a capping operation for preventing the ink nozzles from drying.

In the state shown in FIGS. 1 and 2 where the printing operation included in the operation sequence is being carried out, both the caps 27*a,* 27*b* and the wipers 28*a,* 28*b* are retracted to the bottom dead center where the caps and wipers are out of interference with the reciprocating print heads 23, 24. At this point of time, the position detection switch 42 (contact type) for detecting the cam position is ON, contacting the cam gear 35.

In the state shown in FIGS. 3 and 4 where the wiping operation is being carried out, the cam shaft 34 is rotated to set the cams (the second cams) 34*b,* 34*d* to operating positions where upper ends of both the wipers 28*a,* 28*b* orthogonally overlap with the surfaces of the nozzles at the print heads 23, 24. At this point of time, the position detection switch 42 is ON, contacting the cam gear 35.

Figure 8:
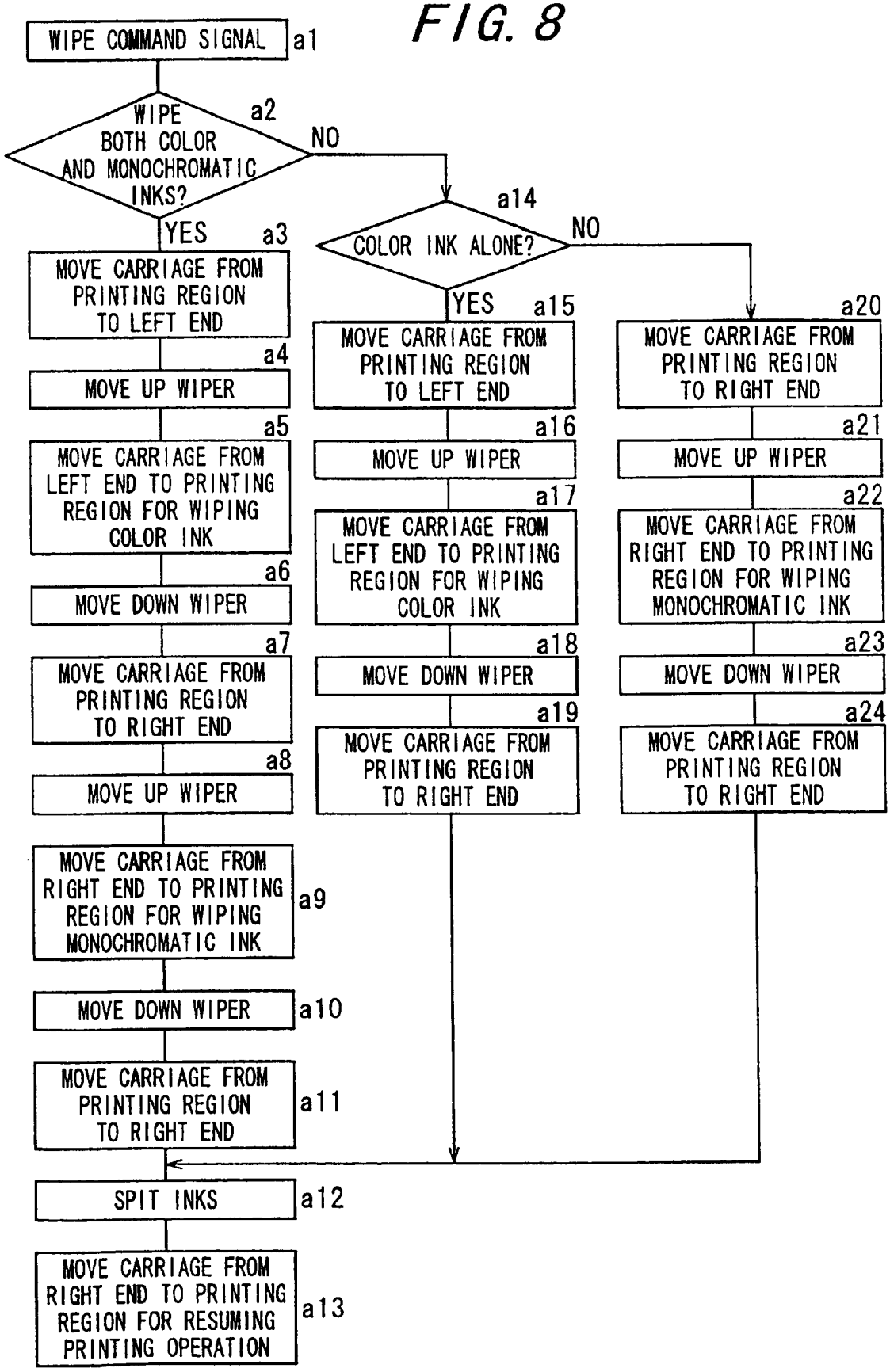
FIG. 8 is a flow chart representing steps of the wiping mode.

In this state, both the wipers 28*a,* 28*b* operate as illustrated in the flow chart of FIG. 8, for example. That is, the wipers 28*a,* 28*b* move up and down in conjunction with the reciprocal movement of the carriage 22. Specifically, after the wipers 28*a,* 28*b* are raised, the carriage 22 is moved for performing the wiping operation. Immediately after the wiping operation, the wipers 28*a,* 28*b* are lowered to allow for the movement of the carriage 22. The wiping operation is carried out by effecting these movements in combination.

More specifically, a wipe command signal triggers the wiping operation in Step a1. If the control unit 50 determines in the subsequent Step a2 that the wipe command indicates the wiping of both a color ink and a monochromatic ink, the control proceeds to Step a3 where the carriage 22 is moved from the printing region substantially of the same area as that of a sheet conveyance region shown in FIG. 10A to the one end of the primary scanning movement defined at the left end of the main frame 21 so as to be positioned directly above the maintenance station L6 on one side. In the subsequent Step a4, the control unit 50 controllably drives the motor 51 to rotate the cam shaft 34 based on a number of feed steps and a signal from the position detection switch 42, thereby bringing the second cams 34*b,* 34*d* into rotation to raise the wipers 28*a,* 28*b* to the wiping mode positions.

In Step a5, the carriage 22 at the left end is moved toward the printing region along the primary scanning direction, thereby performing the wiping of the color ink. Thus, the wiper 28*a* cleans by wiping the nozzle surface at the print head 23 for color ink. In the subsequent Step a6, the control unit 50 controllably drives the motor 51 to rotate the cam shaft 34 based on a number of feed steps and a signal from the position detection switch 42, thereby bringing the second cams 34*b,* 34*d* into rotation to lower the wipers 28*a,* 28*b* to places out of interference with the print heads 23, 24. In the subsequent Step a7, the carriage 22 is moved from the printing region to the other end of the primary scanning movement defined at the right end of the main frame 21, so that the carriage 22 is positioned directly above the other maintenance station R21.

In the subsequent Step a8, the control unit 50 controllably drives the motor 51 to rotate the cam shaft 34 based on a number of feed steps and a signal from the position detection switch 42, thereby bringing the second cams 34*b,* 34*d* into rotation to raise the wipers 28*a,* 28*b* to the wiping mode positions. In the subsequent Step a9, the carriage 22 at the right end is moved toward the printing region along the primary scanning direction, thereby performing the wiping of the monochromatic ink. Thus, the wiper 28*b* cleans by wiping the nozzle surface at the print head 24 for monochromatic ink. In the subsequent Step a10, the control unit 50 controllably drives the motor 51 to rotate the cam shaft 34 based on a number of feed steps and a signal from the position detection switch 42, thereby bringing the second cams 34*b,* 34*d* into rotation to lower the wipers 28*a,* 28*b* to places out of interference with the print heads 23, 24. In the subsequent Step a11, the carriage 22 is moved from the printing region to the right end of the main frame 21, so that the carriage 22 is positioned directly above the other maintenance station R21.

In the subsequent Step a12, the print heads 23, 24 perform the purging cleaning by individually spitting the inks toward the waste ink receiving portion of the maintenance station R21. In the subsequent Step a13, the carriage 22 at the right end is moved to the printing region along the primary scanning direction, so that the printing operation is resumed.

If the control unit 50 determines in Step a2 that the wipe command does not indicate the wiping of both the color ink and the monochromatic ink and then determines in Step a14 that the wipe command indicates the wiping of the color ink, the same operations as in Steps a3 to a7 are performed in Steps a15 to a19 for cleaning by wiping the nozzle surface at the print head 23 for color ink. After the purging cleaning is performed in the subsequent Step a12, the printing operation is resumed in Step a13.

If the control unit 50 determines in Step a2 that the wipe command does not indicate the wiping of both the color ink and the monochromatic ink and then determines in Step a14 that the wipe command indicates the wiping of the monochromatic ink rather than the color ink, the same operations as in Steps a7 to all are performed in Steps a20 to a24 for cleaning by wiping the nozzle surface at the print head 24 for monochromatic ink. After the purging cleaning is performed in the subsequent Step a12, the printing operation is resumed in Step a13.

In the state shown in FIGS. 5 and 6 where the capping operation is being carried out, the carriage 22 rests at the standby position on the left side after completion of the printing operation or initialization, while the cam shaft 34 is rotated to set the cams (the first cams) 34*a,* 34*c* to operation positions so that the maintenance station L6 along with the cap 27 are raised to seal the nozzle surfaces at the print heads 23, 24. At this point of time, the position detection switch 42 is OFF, placed out of contact with the cam gear 35.

Figure 9:
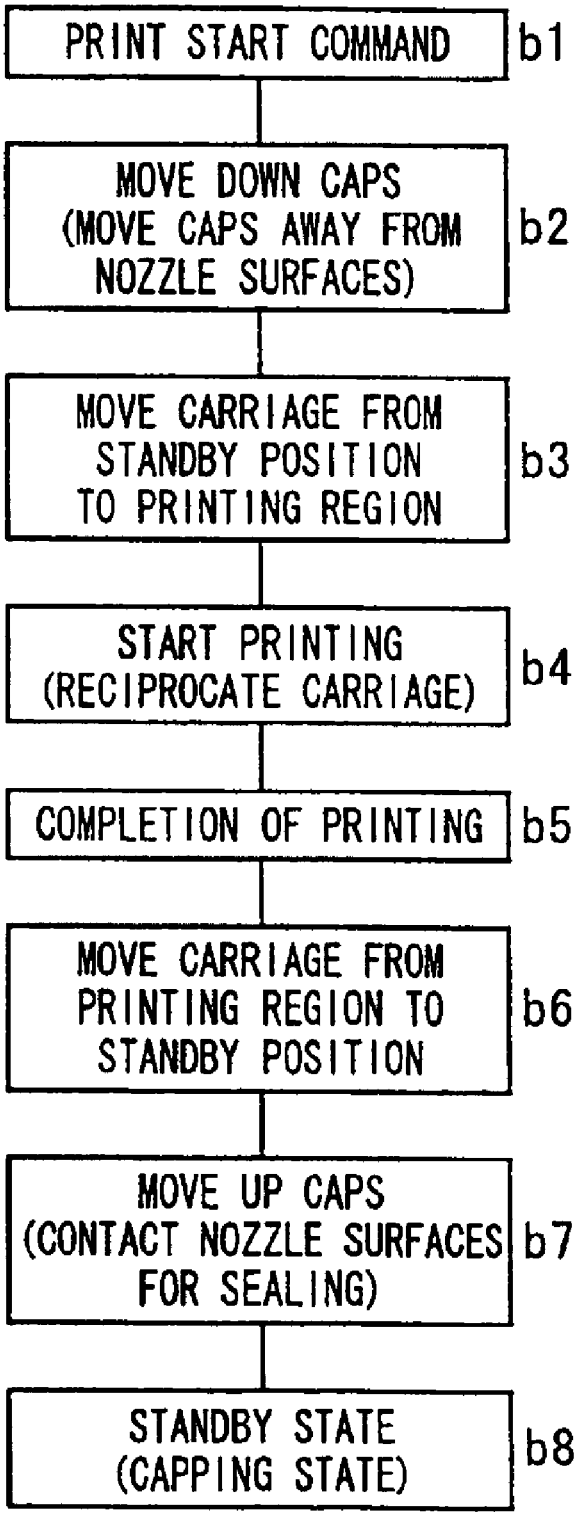
FIG. 9 is a flow chart representing steps of the capping mode.

The capping operation may be performed as illustrated in the flow chart of FIG. 9, for example. Before the carriage 22 at the standby position is moved, the cap 27 is lowered to establish a state where the carriage 22 is allowed to move. On the other hand, after the carriage 22 is returned to the standby position from the printing region, the capping operation is carried out by raising the cap 27.

More specifically, in response to a print start command given in Step b1, Step b2 is performed where the control unit 50 controllably drives the motor 51 to rotate the cam shaft 34 based on a number of feed steps and a signal from the position detection switch 42, thereby bringing the first cams 34*a,* 34*c* into rotation to lower the caps 27*a,* 27*b* from the capping mode positions to the printing mode positions. Thus, the caps 27*a,* 27*b* are moved away from the nozzle surfaces at the print heads 23, 24. In the subsequent Step b3, the carriage 22 at the standby position is moved to the printing region. In Step b4, the printing operation is started while the carriage 22 reciprocates along the primary scanning direction.

At termination of the printing operation in Step b5, the carriage 22 at the printing region is moved to the standby position in Step b6. In Step b7, the control unit 50 controllably drives the motor 51 to rotate the cam shaft 34 based on a number of feed steps and a signal from the position detection switch 42, thereby bringing the first cams 34*a,* 34*c* into rotation to raise the caps 27*a,* 27*b* from the printing mode positions to the capping mode positions. Thus, the caps 27*a,* 27*b* come into intimate contact with the nozzle surfaces at the print heads 23, 24 for sealing the nozzle surfaces. In the subsequent Step b8, the print heads stay at the standby positions to maintain a capped state until the next print start command is given.

Figure 10A:
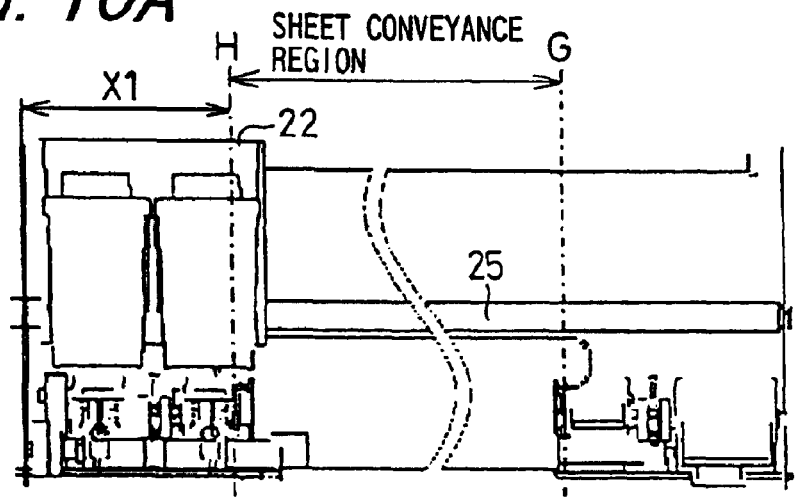
FIGS. 10A and 10B are diagrams for comparison between the print head maintenance mechanism according to the one embodiment of the invention and the prior art.
Figure 10B:
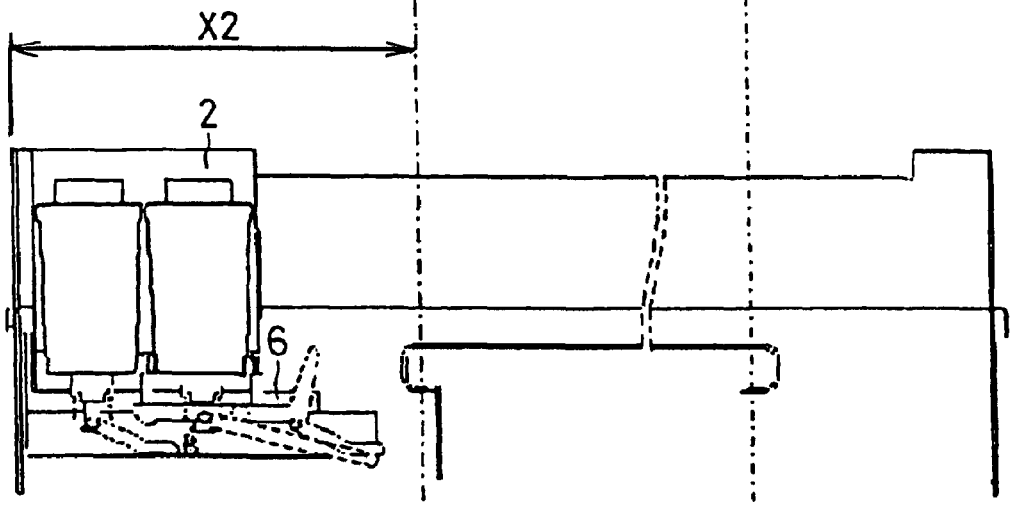
FIG. 10B PRIOR ART
Figure 11A:
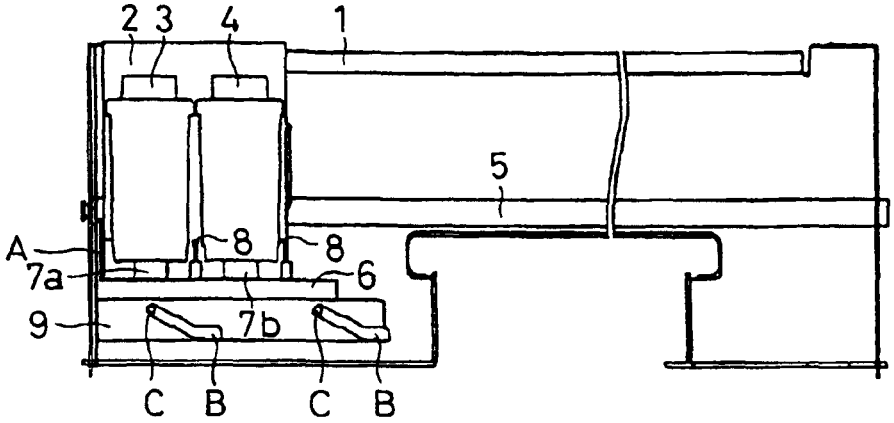
FIG. 11A PRIOR ART
FIGS. 11A to 11C are diagrams showing one example of the conventional print head maintenance mechanism.
Figure 11B:
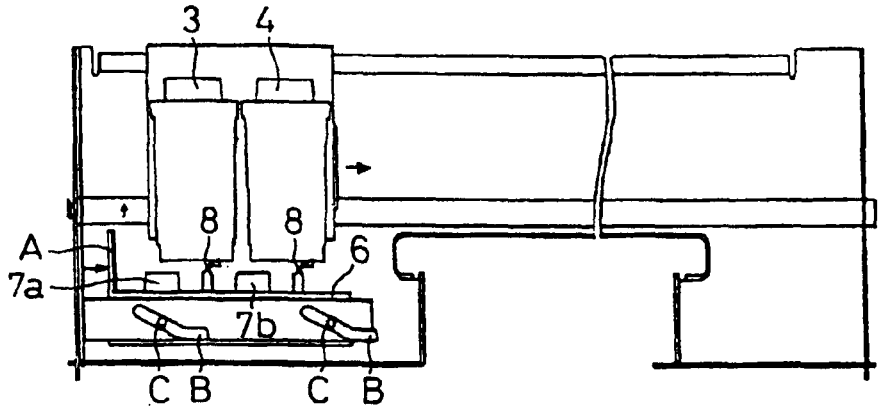
FIG. 11B PRIOR ART
Figure 11C:
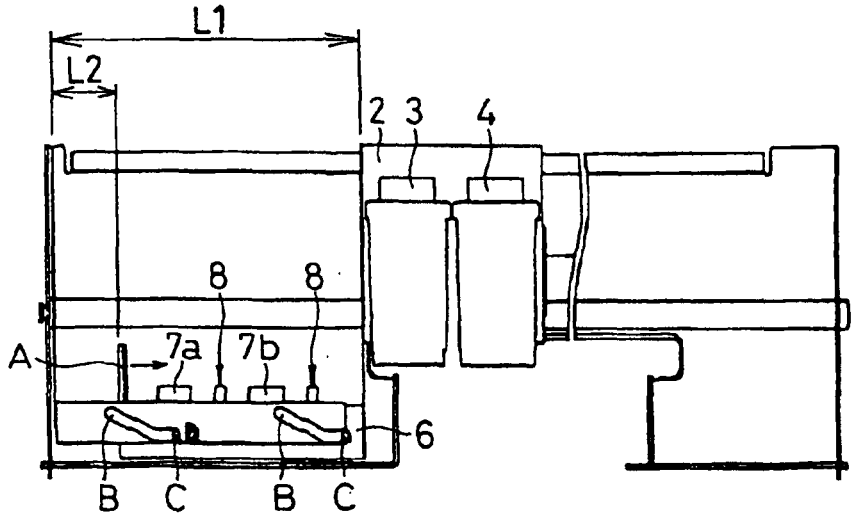
FIG. 11C PRIOR ART

As described above, the cap holders 33*a,* 33*b* and the wiper holders 29*a,* 29*b* can be vertically shifted by rotating the first cams 34*a,* 34*c* and the second cams 34*b,* 34*d,* whereby the maintenance mechanism can be switched to the printing mode position for permitting the normal printing operation, the capping mode position for sealing the nozzle surfaces at the print heads 23, 24, and the wiping mode position for cleaning by wiping the nozzle surfaces. Hence, the mechanism only requires a space allowing for the vertical movement of the cap holders 33*a,* 33*b* and the wiper holders 29*a,* 29*b,* negating the need for the widthwise increase of space. With the print head maintenance mechanism according to one embodiment of the invention as shown in FIG. 10A, the main frame 21 only needs to define a space for provision of the maintenance station L6, which is, as represented by X1 in FIG. 10A, substantially as large as to accommodate the carriage 22. In contrast, the conventional arrangement shown in FIG. 10B requires a space, as represented by X2 in FIG. 10B, which is larger than the space X1 in order to accommodate the carriage 22 as well as to allow the slide case 6 to move along the primary scanning direction. Thus, as shown in FIGS. 10A and 10B, the provision of the print head maintenance mechanism of the invention does not require the widthwise (the primary scanning direction) expansion of the ink-jet printing machine, thus permitting the realization of the compact design thereof, provided that the sheet conveyance region through which a sheet to be printed is conveyed is of a constant size. In addition, one revolution of the single cam shaft 34 causes the two types of cams 34*a,* 34*c;* 34*b,* 34*d* to rotate for switching the maintenance mechanism to the three mode positions, thus ensuring the positive maintenance operations. Furthermore, the switching function can be implemented in a simple construction of an easy control, contributing to the low cost fabrication of the maintenance mechanism.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A print head maintenance mechanism for use in an ink jet printing machine in which printing is carried out by driving a carriage carrying a print head, the maintenance mechanism comprising:

a cap for preventing a nozzle provided at the print head from drying;

a cap holder retaining the cap and allowed to move along directions orthogonal to a primary scanning direction and a secondary scanning direction of the print head;

a first cam which is rotated at a predetermined position;

first biasing means for biasing a bottom portion of the cap holder against the first cam;

a wiper for cleaning by wiping a surface of the nozzle provided at the print head;

a second cam which is rotated at a predetermined position;

a wiper holder retaining the wiper and allowed to move along directions orthogonal to the primary scanning direction and the secondary scanning direction of the print head; and second biasing means for biasing a bottom portion of the wiper holder against the second cam, wherein the first and second cams are mounted to a single cam shaft, and wherein the cam shaft is rotated through one revolution for switching the cap holder and wiper holder between a printing mode position for permitting a normal printing operation, a capping mode position for sealing the surface of the nozzle at the print head with the cap, and a wiping mode position for cleaning by wiping the nozzle surface with the wiper.

2. The print head maintenance mechanism of claim 1, wherein the first biasing means for biasing the cap holder against the first cam comprises a pair of tension springs disposed at places on one of the diagonal lines of the cap holder as equi-spaced from the cam shaft.

3. The print head maintenance mechanism of claim 1, wherein the second biasing means for biasing the wiper holder against the second cam comprises a pair of tension springs disposed at places on opposite sides of the cam shaft as equi-spaced from an axis of the wiper holder orthogonal to the cam shaft.

4. The print head maintenance mechanism of claim 1, wherein the first biasing means for biasing the cap holder against the first cam comprises a pair of tension springs disposed at places on one of the diagonal lines of the cap holder as equi-spaced from the cam shaft, and wherein the second biasing means for biasing the wiper holder against the second cam comprises a pair of tension springs disposed at place on opposite sides of the cam shaft as equi-spaced from an axis of the wiper holder orthogonal to the cam shaft.

* * * * *